US006032942A

United States Patent [19]

Cho

[11] Patent Number: 6,032,942

[45] Date of Patent: Mar. 7, 2000

[54] SECONDARY CASSETTE FEEDER FOR IMAGE FORMING APPARATUS

[75] Inventor: Won-Mo Cho, Kyungki-do, Rep. of Korea

[73] Assignee: SamSung Electronics Co., Ltd., Suwon, Rep. of Korea

[21] Appl. No.: 08/966,536

[22] Filed: Nov. 10, 1997

[30] Foreign Application Priority Data

Nov. 8, 1996 [KR] Rep. of Korea ..... 96 52923

[51] Int. Cl.[7] ..... B65H 3/44; B65H 5/26

[52] U.S. Cl. ..... 271/9.11; 271/145; 271/162

[58] Field of Search ..... 271/9.02, 9.04, 271/9.01, 9.11, 162, 164, 145

[56] References Cited

U.S. PATENT DOCUMENTS

| | | | |
|---|---|---|---|
| Re. 35,341 | 10/1996 | Kikuchi et al. | 271/164 |
| 4,565,360 | 1/1986 | Runzi | 271/127 |
| 4,577,849 | 3/1986 | Watanabe | 271/9.02 |
| 4,770,555 | 9/1988 | Deschamps et al. | 271/9.11 |
| 4,822,019 | 4/1989 | Nagira | 271/9.02 |
| 4,958,822 | 9/1990 | Rutishauser et al. | 271/9.11 |
| 5,240,238 | 8/1993 | Lee | 271/9.11 |
| 5,666,595 | 9/1997 | Sameshima et al. | 271/145 |
| 5,732,321 | 3/1998 | Ishizuka et al. | 271/9.11 |

FOREIGN PATENT DOCUMENTS

| | | | |
|---|---|---|---|
| 362079139 | 4/1987 | Japan | 271/9.11 |

*Primary Examiner*—H. Grant Skaggs
*Attorney, Agent, or Firm*—Robert E. Bushnell, Esq.

[57] ABSTRACT

A secondary cassette feeder enhances the capacity of an image forming apparatus having a main body provided with a primary cassette feeder for introducing sheets of print media to the apparatus and a first pickup roller, disposed inside the main body and driven by a motor, for feeding the sheets of print media in accordance with a synchronizing signal. The secondary cassette feeder includes: a plurality of idler gears engaged with the first pickup roller; and a second pickup roller, engaged with the idler gears, for feeding auxiliary sheets of print media in accordance with the synchronizing signal. The secondary cassette feeder further includes a set of contiguous gears, engaged with at least one of the idler gears, for driving the second pickup roller. The contiguous gears are ganged together by a swing arm, the swing arm being biased by a spring anchored at an interior point of the secondary cassette feeder. The idler gears are passive gears, disposed so as to transfer drive power from the first pickup roller to the second pickup roller.

4 Claims, 2 Drawing Sheets

SECONDARY CASSETTE FEEDER FOR IMAGE FORMING APPARATUS

CLAIM OF PRIORITY

This application makes reference to, incorporates the same herein, and claims all benefits accruing under 35 U.S.C. §119 from an application for SECONDARY CASSETTE FEEDER FOR IMAGE INFORMING SYSTEM earlier filed in the Korean Industrial Property Office on the $8^{th}$ of November 1996 and there duly assigned Ser. No. 52923/1996.

BACKGROUND OF THE INVENTION

1. Field of the Invention

The present invention relates to an image forming apparatus such as a copy machine or laser printer having a secondary or auxiliary cassette feeder for enhanced paper loading capacity and, more particularly, to a secondary cassette feeder for introducing sheets of paper to the main system using the same driving force as the primary feeder.

2. Description of the Related Art

To general, image forming apparatus produce images on sheets of print media (e.g. paper) which are feed into the machine one sheet at a time using a cassette feeder. A separate feeder is often used to increase the paper capacity or enhance the operation.

In the operation of earlier laser printer, a print signal is supplied from a computer or, in the case of a copy machine, from a microprocessor. The print signal activates a first pick-up roller which draws a sheet of paper loaded on a first knock-up plate. The selected sheet of paper is then guided around a guide roller through a pair of friction rollers and, using a drive motor, is conveyed to a transferring roller charged to a high voltage.

Meanwhile, a scanning unit generates a laser beam corresponding to video signals input from the computer and scans a drum to form an electrostatic latent image thereon which is developed using toner in a developer. The leading edge of the traveling sheet of paper meets with the developed images on trip drum at a specific point according to a synchronizing signal, whereupon the toner image is transferred onto the paper. The final image is formed by a fixing unit which fuses the toner to the paper using high temperature.

A secondary cassette feeder is provided below a main body, for feeding auxiliary sheets of paper loaded on a second knock-up plate. An electrical connector is required to supply the computer's synchronizing signal and a power supply voltage front the main body to the lower portion of the system. A second pickup roller is driven by a separate motor, through a series of timing gears, to convey the paper up through a second pair of friction rollers to the friction rollers of the main body. Thereafter, the above-described print processes are performed via the driving force from the motor of the main body.

Accordingly, the earlier second cassette feeder is driven separately, which inherently leads to synchronization problems. As a result, paper jamming and shredding may occur, which wastes paper and is an inconvenience to the user. Also, if the separate motors are even slightly out in sync as they are driven, the system tends to be noisy such that the mechanism undergoes undue wear and tear. In addition, the separate motors require more gearing and associated components and wiring in order to transfer the driving force to the lower portion of the secondary cassette feeder, thereby increasing the cost of manufacture as well as the size of the system.

BACKGROUND OF THE INVENTION

It is therefore an object of the present invention to provide a secondary cassette feeder for an image forming apparatus, which can reliably feed sheets of paper to the main body of the system.

Another object of the present invention is to provide a secondary cassette feeder for an image forming apparatus, in which the system's main drive is directly transferred to the secondary cassette feeder.

Yet another object of the present invention is to provide a secondary cassette feeder for an image forming apparatus, which does not necessitate the synchronization of a separate drive motor.

To achieve these and other advantages and in accordance with the purpose of the present invention, as embodied anti broadly described, there is provided a secondary cassette feeder which enhances the capacity of an image forming apparatus having a main body provided with a primary cassette feeder for introducing sheets of print media to the system, and a first pickup roller, installed inside the main body and driven by a motor, for feeding the sheets of print media in accordance with a synchronizing signal. The secondary cassette feeder includes a plurality of idler gears engaged with the first pickup roller; and a second pickup roller, engaged with the idler gears, for feeding auxiliary sheets of print media in accordance with the synchronizing signal.

A set of contiguous gears is further provided, being engaged with at least one of the idler gears, for driving the second pickup roller. The contiguous gears are ganged together by a swing arm biased by a spring anchored at an interior point of the secondary cassette feeder. The idler gears are passive gears, installed to transfer drive power from the first pickup roller to the second pickup roller.

BRIEF DESCRIPTION OF THE ATTACHED DRAWING

A more complete appreciation of the invention, and many of the attendant advantages thereof will be readily apparent as the same becomes better understood by reference to the following detailed description when considered in conjunction with the accompanying drawings in which like reference symbols indicate the same or similar components, wherein:

FIG. 1 schematically shows the structure of a laser printer in which an earlier secondary cassette feeder is used;

DETAILED DESCRIPTION OF THE PREFERRED EMBODIMENT

Figure 1:
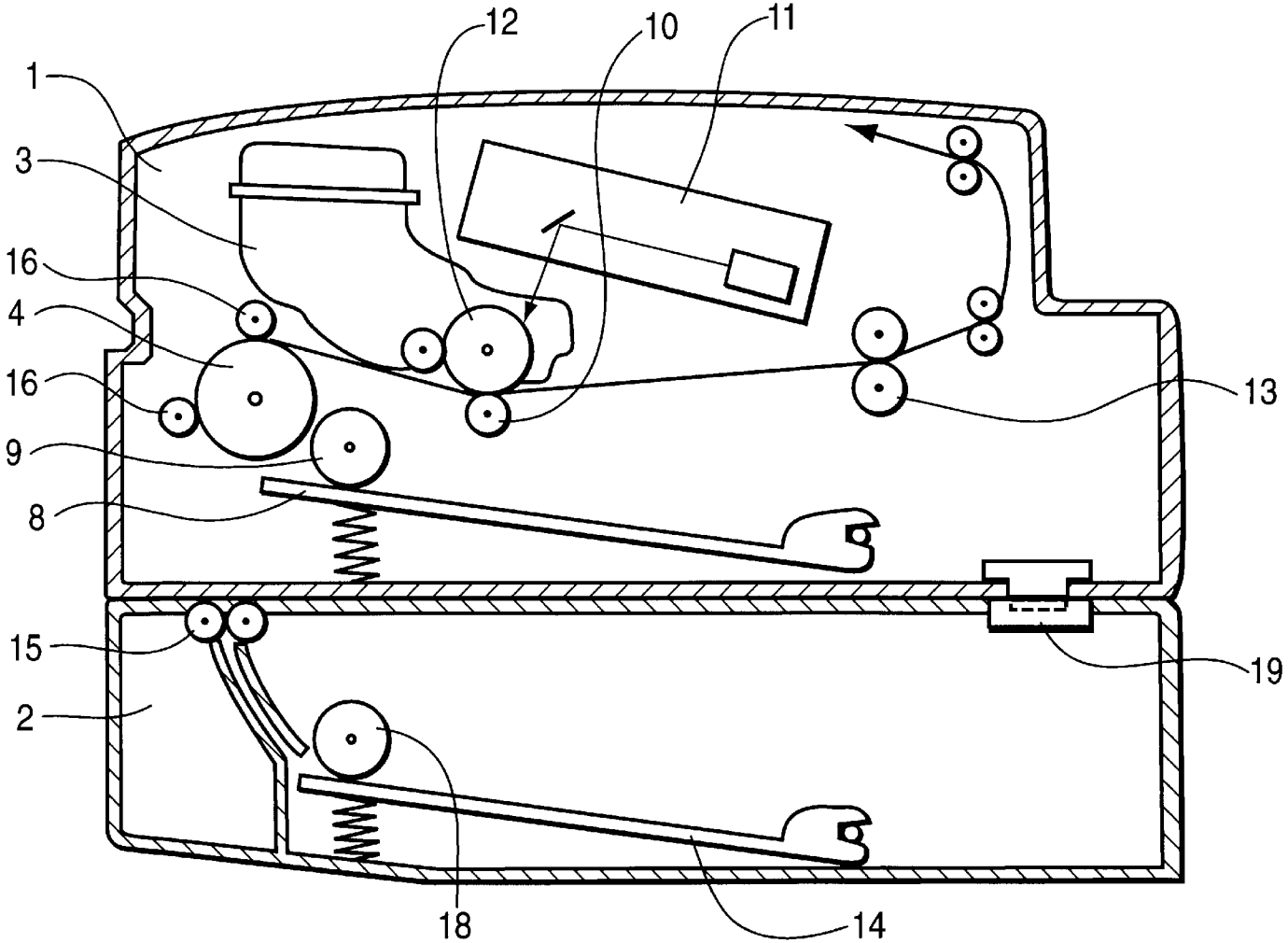
Figure 2:
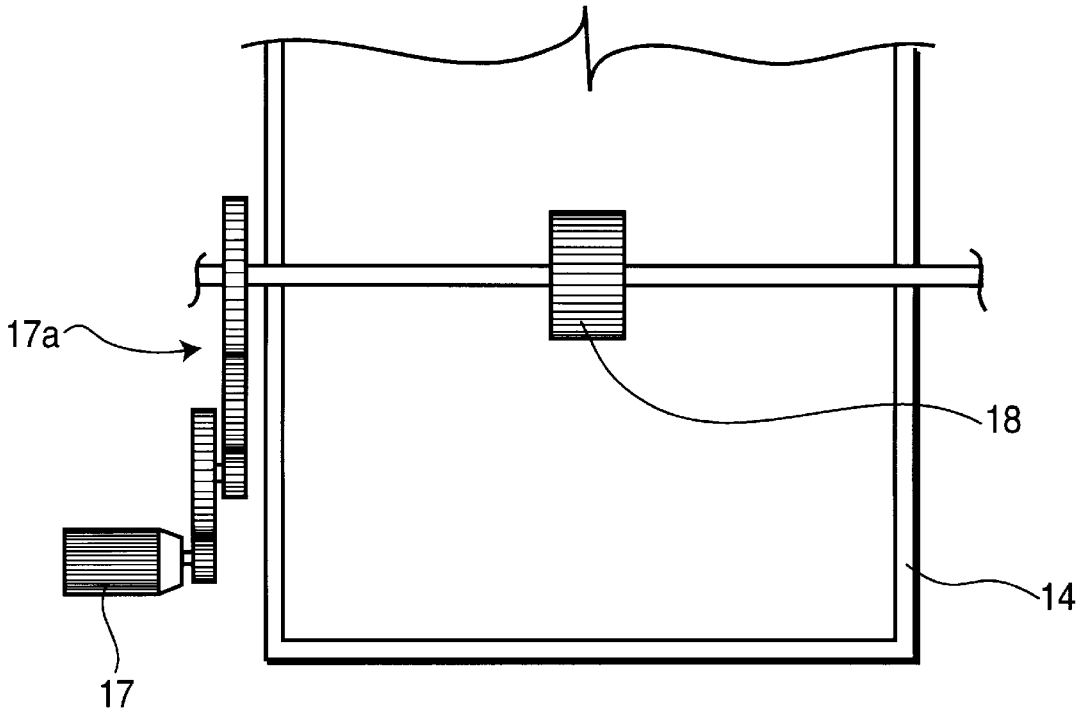
FIG. 2 is a plan view of the secondary cassette feeder of FIG. 1.

FIGS. 1 and 2 illustrate the operation of an earlier laser printer which a secondary cassette feeder is utilized.

A print signal is supplied from a computer or, in the case of a copy machine, from a microprocessor. The print signal activates a first pick-up roller 9 which draws a sheet of paper loaded on a first knock-up plate 8. The selected sheet of paper is then fed around a guide roller 4 through a pair of friction rollers 16 and using a drive motor is conveyed to a transferring roller 10 charged to a high voltage.

A scanning unit 11 generates a laser beam corresponding to video signals input from the computer and scans a drum 12 to form an electrostatic latent image thereon which is developed using a toner in a developer 3. The leading edge of the traveling sheet of paper meets the developed image on the drum 12 at a specific point according to a synchronizing signal whereupon the toner image is transferred onto the paper. The final image is formed by a fixing unit 13 which fuses the toner to the paper using high temperature.

A secondary cassette feeder 2 is provided below a main body 1 for feeding auxiliary sheets of paper loaded on a second knock-up plate 14. An electrical connector 19 is required to supply the computer's synchronizing signal and a power supply voltage from the main body 1 to the lower portion of the system. A second pickup roller is driven by a separate motor 17 through a series of timing gears 17*a* to convey the paper up through a second pair of friction roller 15 to the friction roller 16 of the main body 1. Thereafter, the above-described print processes are performed via the driving force from the motor of the main body 1.

Figure 3:
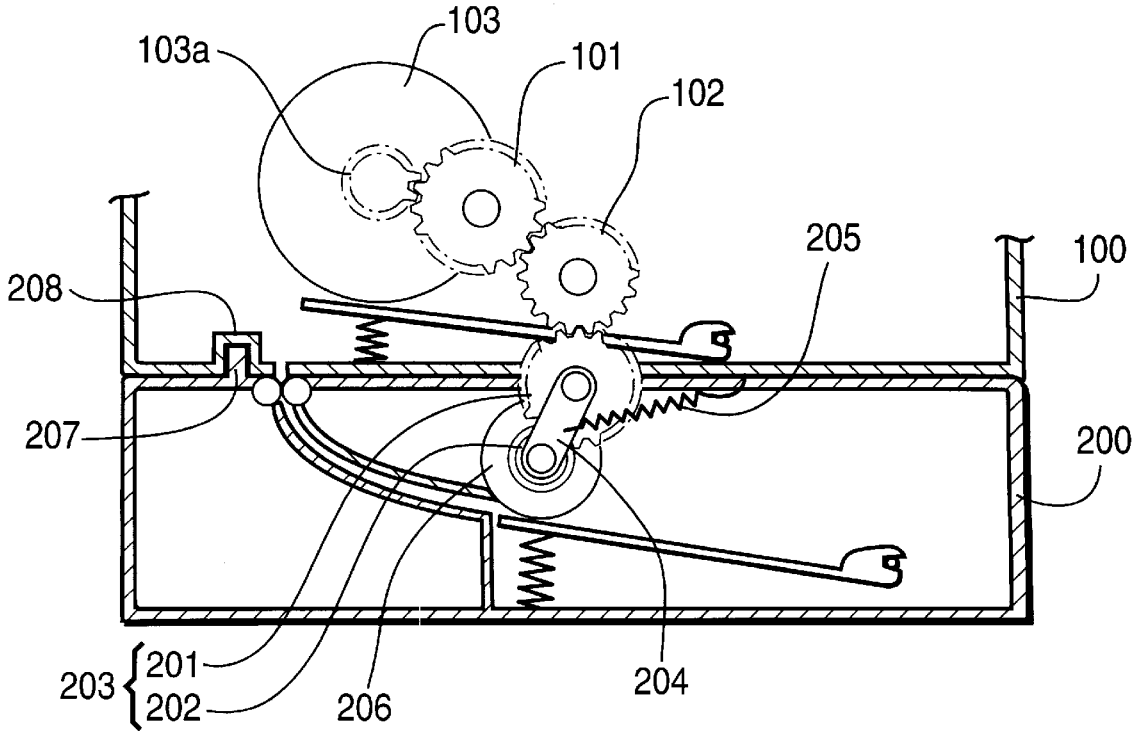
FIG. 3 is a cross-sectional side view showing the geared operation of a secondary cassette feeder according to the present invention.

Referring to FIG. 3, a secondary cassette feeder 200 coupled to the bottom of a main body 100 performing primary cassette feeding, using, for example, an engaging recess 208 and a guide pin 207 inserted therein. The main body 100 is provided with a first pickup roller 103 for feeding sheets of paper. The first pickup roller 103 is driven by a motor (not shown) in accordance with a synchronizing signal supplied by the image forming apparatus. A plurality of idler gears 101 and 102 are engaged with the first pickup roller 103 as passive gears, installed to transfer drive to the secondary cassette feeder 200. To accomplish this, the first pickup roller 103 has a coincident gear 103*a* for transferring drive power from the motor to the idler gears 101 and 102.

The secondary cassette feeder 200 has a second pickup roller 206 which is engaged with one of the idler gears (102) via a set of contiguous gears 203 composed of first and second gear components 201 and 202. Here, the first gear component 201 is meshed with the idler gear 102 and the second gear component 202 is coincident with the second roller 206. Thus, the second pickup roller 206 is driven by the same force driving the first pickup roller 103, to thereby feed auxiliary sheets of print media in accordance with the synchronizing signal.

The first and second gear components 201 and 202 of the contiguous gears 203 are ganged together by a swing arm 204. The swing arm 204 is biased by a spring 205 anchored at an interior point of the secondary cassette feeder 200, to thereby apply tension to the second pickup roller 206.

With the main body 100 and secondary cassette feeder 200 coupled as above, the idler gear 102 engages with the contiguous gears 203. Thus, a driving force carried by the idler gears 101 and 102 is, at the proper gear-reduction ratio instantly transmitted to the secondary cassette feeder 200, so that the second pickup roller 206 rotates, feeding auxiliary sheets of paper up into the main body 100.

Therefore, wisthout the use of a separate motor for secondary feeding, tho second pickup roller 206 is driven by the driving force of the existing motor for the main body 100. Also, there is no need to individually control two motors when employing a secondary cassette feeder, so that the electrical connector of the earlier arrangement is eliminated and synchronization is simplified Moreover, since both pickup rollers are driven by a single motor, operational noise is reduced, excessive paper jamming is prevented and miniaturization is facilitated.

It will be apparent to those skilled in the art that various modifications can be made in the secondary cassette feeder for an image forming apparatus according to the present invention, without departing from the spirit of the invention. Thus, it is intended that the present invention cover such modifications as well as variations thereof within the scope of the appended claims and their equivalents.

What is claimed is:

1. A paper feeding apparatus comprising:

a main body having a first gear;

a cassette feeder attachable to said main body, including:

a second gear engaged with said first gear of said main body when said cassette feeder is attached to said main body; and a pickup roller connected to said second gear, for feeding and transmitting a cut paper contained in said cassette feeder to said main body;

a third gear engaged with said second gear and thereby rotating said pickup roller connected to said second gear; and a swing arm, ganging together said second gear and said third gear, said swing arm being biased by a spring anchored at an interior point of said cassette feeder, said spring arm maintaining said second gear in engagement with said first gear when said cassette feeder is attached to said main body.

2. A cassette comprising:

a housing containing a cut sheet;

a first passive gear contained in said housing; and a pickup roller connected to said first passive gear, feeding said cut sheet to outside of said housing;

a main body having a second gear for rotating said first passive gear when said housing is attached to said main body; and a spring connected between said first passive gear and said housing to maintain said first passive gear in contact with said second gear when said main body is attached to said cassette.

3. A paper feeding apparatus comprising;

a main body having a first cassette feeder and a first gear contained in a first housing;

a second cassette feeder attachable to said main body, including:

a second housing;

a second passive gear contained in said second housing and rotated by said first gear when said second cassette feeder is attached to said main body; and a pickup roller connected to said second passive gear, feeding a cut sheet contained in said second housing and transmitting said cut sheet to said main body; and a spring anchored in said second housing and connected to said second passive gear, maintaining said second passive gear in contact with said first gear.

4. A paper feeding apparatus comprising:

a main body having a first cassette feeder and a first gear contained in a first housing;

a second cassette feeder attachable to said main body, including:

a second housing;

a second passive gear contained in said second housing and rotated by said first gear when said second cassette feeder is attached to said main body; and a pickup roller connected to said second passive gear, feeding a cut sheet contained in said second housing and transmitting said cut sheet to said main body;

a third gear engaged with said second passive gear and rotating said pickup roller connected to said second passive gear; and a swing arm ganging together said second passive gear and said third gear, said swing arm being biased by a spring anchored at an interior point of said cassette feeder, said spring arm maintaining said second passive gear in engagement with said first gear when said cassette feeder is attached to said main body.

* * * * *